United States Patent [19]

Barbosa

[11] 4,111,428

[45] Sep. 5, 1978

[54] GAME OF NAVAL STRATEGY AND CHANCE

[76] Inventor: Ely Rubens Barbosa, Av. Itacira, No. 2106, Sao Paulo, Brazil

[21] Appl. No.: 707,030

[22] Filed: Jul. 20, 1976

[30] Foreign Application Priority Data

Jan. 13, 1976 [BR] Brazil ..... 00180

[51] Int. Cl.[2] ..... A63F 3/00

[52] U.S. Cl. ..... 273/262

[58] Field of Search ..... 273/131, 134, 137, 131 BB, 273/131 K

[56] References Cited

U.S. PATENT DOCUMENTS

| | | | |
|---|---|---|---|
| 972,382 | 10/1910 | Johnson-Jervis | 273/131 BB |
| 1,294,256 | 2/1919 | George | 273/131 K |
| 1,366,181 | 1/1921 | Hodgson | 273/131 K |
| 1,624,970 | 4/1927 | Owye | 273/131 K |
| 2,277,301 | 3/1942 | Channer | 273/134 D |
| 2,414,165 | 1/1947 | Paschal | 273/137 R |
| 3,343,841 | 9/1967 | Arend | 273/131 BB |

FOREIGN PATENT DOCUMENTS

| | | | |
|---|---|---|---|
| 179,772 | 10/1917 | Canada | 273/131 K |

*Primary Examiner*—Richard C. Pinkham
*Assistant Examiner*—Harry G. Strappello
*Attorney, Agent, or Firm*—Robert E. Burns; Emmanuel J. Lobato; Bruce L. Adams

[57] ABSTRACT

A game of strategy of chance having a board with a major surface constituting a playing surface thereof having indicia corresponding to a plurality of blocks of equal dimensions. Each of the larger blocks is subdivided into four smaller blocks. A plurality of playing pieces are provided for the players. These playing pieces are representative of moveable weapon systems that can be moved and turned on by the players upon payment of certain monetary amounts. Play money is provided for such payments. The play money is a plurality of monetary elements of different monetary values. The playing pieces also include fixed targets. The pieces representative of moveable weapon system have seven different configurations representative of seven different types of weapon systems each of which has an effective range of fire and the playing pieces corresponding to weapon systems fire upon targets constituting other weapon systems or some of the fixed targets. Firing takes place after a move. The distance fired within the effective range is determined by throwing a die. When the result on the die is within the firing range and the playing piece is a distance of small squares from a selected target piece corresponding to the result of the throw of the die the target piece is destroyed and it is removed from the board. The play money also is used to repurchase playing pieces at set prices.

2 Claims, 2 Drawing Figures

GAME OF NAVAL STRATEGY AND CHANCE

BACKGROUND OF THE INVENTION

This patent application has as its objective a set for entertainment, which was carefully planned so as to be strikingly outstanding compared with other similar objects known up to the present time.

According to what is generally known, the majority of children and a large number of adults are very fond of passing the time amusing themselves with games which range from the simplest, such as dominoes, tracks, and draughts, up to the more intellectual ones, such as those which demand considerable thought to define the moves and the solutions of the problems met with. Such games have the most varied subjects as their theme: painting, crime, real estate and others.

War has always been a most efficient motif for success in games in which it is a central part. At least two are known which are always the rage: Naval battle, preferred by boys (and who has never played this game?) and "War" the title of which shows it is of foreign origin.

SUMMARY OF THE INVENTION

The game in question uses war as its theme, but develops the moves in a very intelligent manner, giving quite a thrill to the participants, developing their reasoning powers, as well as offering a healthy pastime.

As it is not a simple game, it will demand an active mind from all who take part in it, and a lot of training and skill, for the solutions found for each move will determine the result of the game, which, depending on the situations and the intelligence, may take hours before the game is over.

BRIEF DESCRIPTION OF THE DRAWING

The enclosed drawings illustrate this patent, in which.

DESCRIPTION OF THE PREFERRED EMBODIMENT

Figure 1:
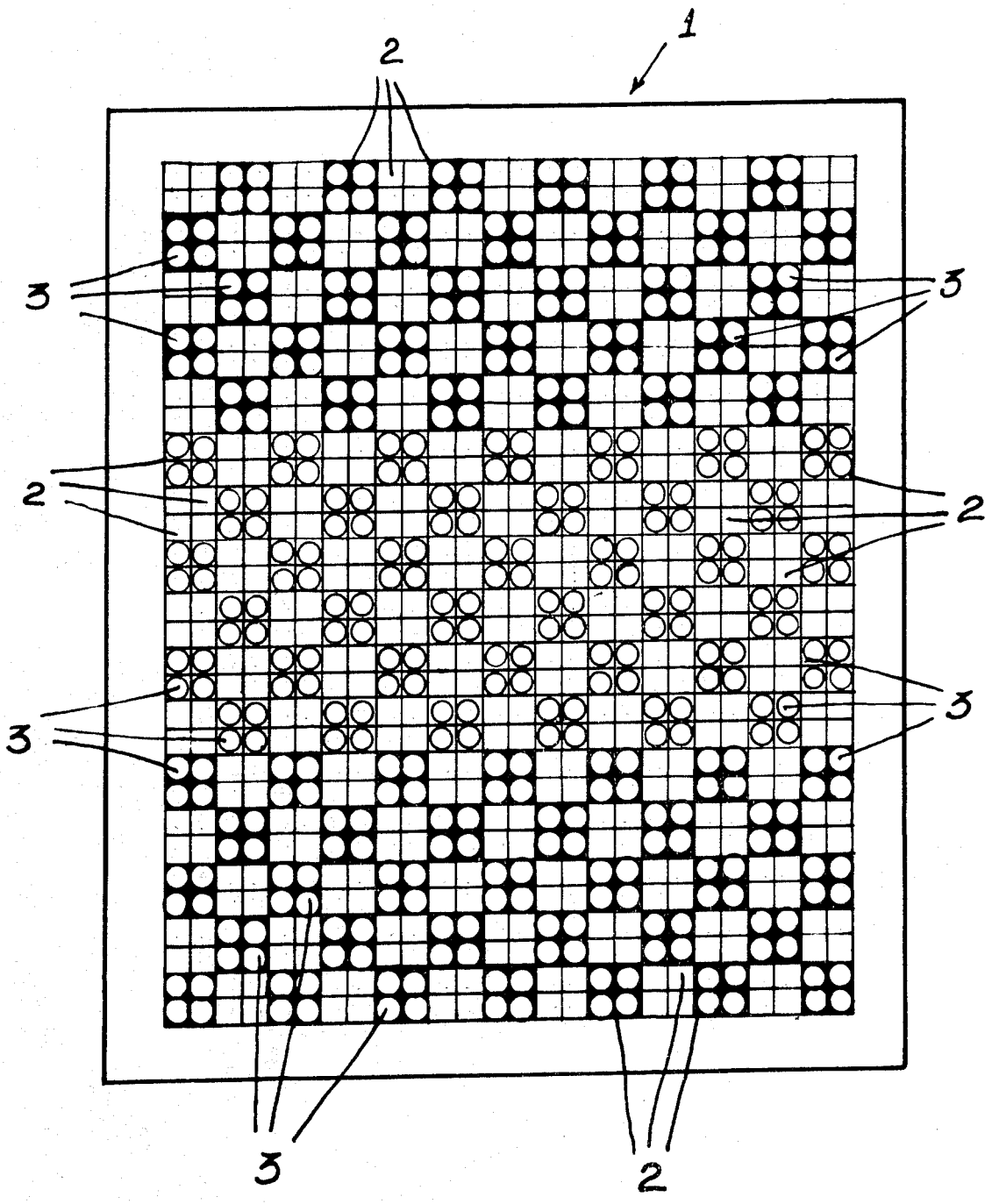
FIG. 1 is a plan view of a board which represents the battlefield, or, to be more precise, the ocean of the set for entertainment in question.
Figure 2:
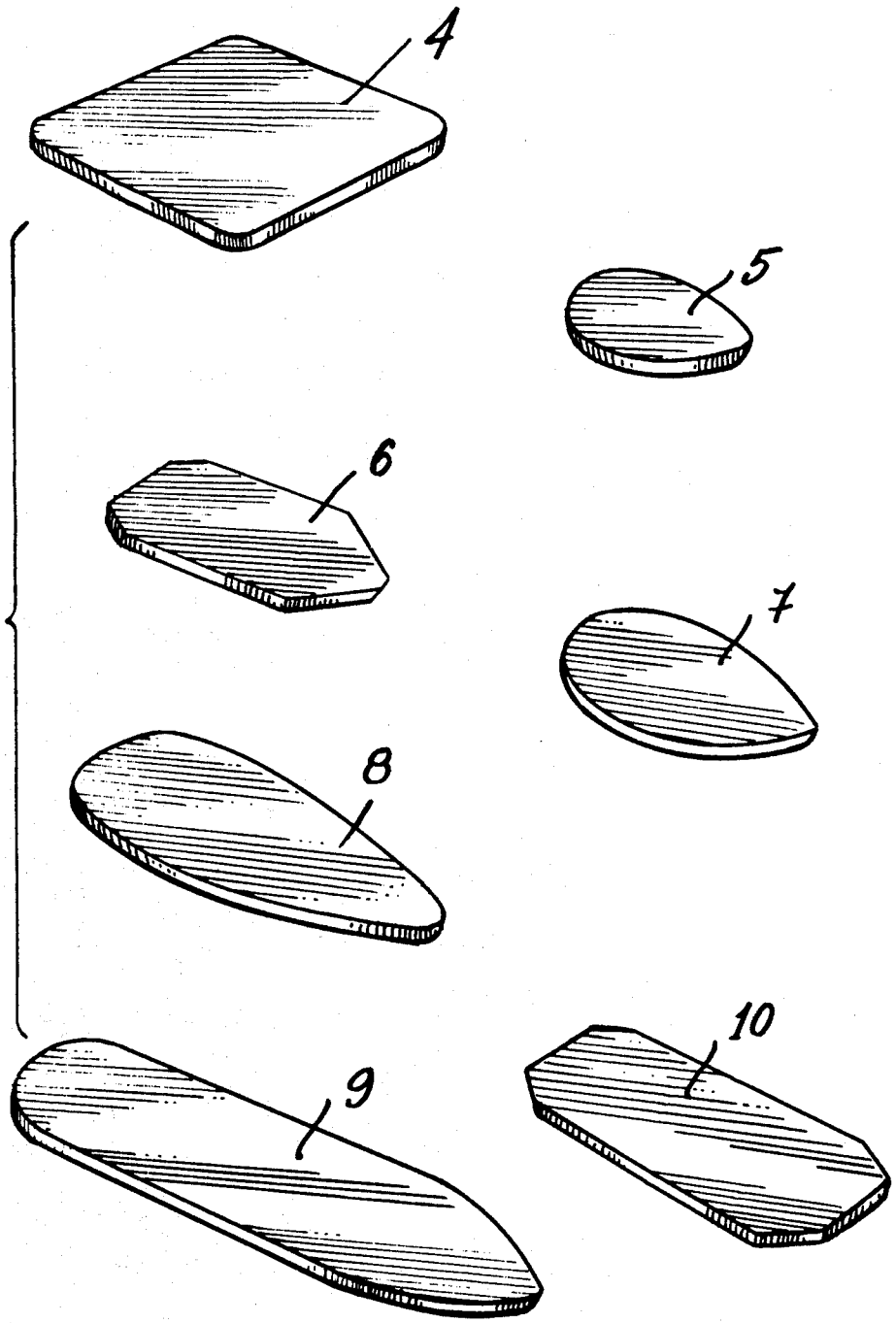
FIG. 2 is a perspective view of playing the set of pieces used in the moves.

According to what is illustrated in the above figures, the game for entertainment as per this patent application, is made up of a board, 1, which preferably has 208 adjacent squares, 2, each one being able to be divided into four smaller squares. Some have a circle 3. The board is formed of two colours which define three transversal strips, a central and larger one and two outside and smaller ones.

For the moves, seven types of pieces are used, all in the form of small plaques with different outlines, a bigger square one, 4, representing a capital city, one in the form of as drop, 5, representing moveable weapon systems such as submarines; one in a rectangular form coming to a point, 6, representing the petrol-tankers; one elongated one with a point, 7, representing destroyers, a further one, 8, with the same shape, but even longer, representing cruisers, and a bigger one still, 9, representing battleships, as well as a last one, an elongated rectangle, 10, representing petroleum bases and aircraft. The playing pieces should be made with different colours. The set also consists of small sheets of paper representing money, as well chance set cards with acts forth thereon to be carried out, punishments and chances.

To start the game, the pieces are divided as follows:

A. WHAT THE GAME IS, ITS OBJECTIVE

This game imitates a real war between countries of different continents.

By sea and air, the competitors try to destroy the military elements of the adversary to defeat him, which can only happen with the destruction of his capital or his bankruptcy which forces him to surrender. (That is when the enemy has no money to move his pieces). As in a real war, every movement of attack or defense or replacement of weapons has its cost, which is greater when the battle waxes hotter.

Therefore, there is a cash-till.

To win, it is necessary to develop tactics (the art of the original lay-out of the pieces) and a strategy (the art of moving the pieces and forcing the enemy to move) for, in this game, luck only appears at the moment of firing the shots, which are fired by a throw of the dice.

A most important factor towards victory is to know how to make proper use of the dollars or whatever money.

WAR IS WAR is a really sensational game, and it is useful, because it helps to develop reasoning in an agreeable and thrilling manner.

It is very easy for whoever follows the instructions with due attention. Try it. You will see. Gook Luck!

B. PRELIMINARY INSTRUCTIONS

1. How many play. How the players are made up. One may play in pairs or in doubles, in which one of the competitors will have to be the cashier. The ideal would be a third or fifth person to look after the cash and to be the umpire. In the case of doubles, one of the partners moves the pieces, draws the spy-cards, pays and receives, while the other identifies the targets, plays and fires, and these and other operations should be carried out in common agreement.

2. The board: The seas and the ocean.

The board, which is divided into squares, represents the ocean (light blue central strip) and the seas (dark blue strips), and the board is put in such a position as to have one sea next to each competitor. (Open the board a table to follow the instructions better).

3. The squares.

There are big squares which contain four smaller squares.

In the big or larger squares, the large pieces will be moved (the aircraft and the capital), and, in the other squares, the medium and small pieces — all of them according to their respective characteristics of motion and firing power.

EXAMPLE 1: (illustr. 1).

Look at the aeroplane — a big piece which can move four spaces, from A to B, containing four big squares.

At the beginning of each game the cashier distributes to each player or pair the following material: (As for the pieces, the cashier holds two aircraft and one submarine for each player, to be sold later).

| PIECES | NUMBER | | "MONEY" US $ |
|---|---|---|---|
| 1 capital | | | |
| 3 aircraft | | | |
| 2 battleships | | | |
| 3 cruisers | 25 notes | at | 1.00 |
| 3 destroyers | 10 notes | at | 5.00 |
| 2 submarines | 10 notes | at | 10.00 |
| 3 petrol tankers | 5 notes | at | 50.00 |
| 1 petroleum base | TOTAL | | 425.00 |

Once the material has been distributed by the cashier the competitors will place their individual capital in the proper fashion in their respective seas (see the indication on the board); after this, they will place their petroleum base in the appropriate spot of the enemy sea. (See the Board). Now these pieces cannot be moved any more, only the capital, and that only after the game has started. Then a throw of a die will decide who will start the placing of the pieces.

Placing of the pieces.

You start, as you win on the dice throwing. A player places four or eighteen pieces in his sea and waits for an adversary also to place four pieces in his sea. Now the player places four more in his sea and the other will place four more in his. The operation is repeated for the third and last time at the same rate (it is necessary to follow this system in order to make it possible for there to be the initial balance between the opposing forces).

Now everything is ready for the game to start to move pieces to the firing positions chosen.

Important notes:

In setting up the tactics, at the beginning of the game, care is taken to defend ones's own capital and a player tries to prevent the enemy from having access to his petroleum hoses, and naturally, there should be no lack in setting up an attack.

The pieces, and the ones which will later be bought from the cashier, can only be set up in a player's own sea. The movement of the pieces is as follows:

1. If a player has already earned the first go, he starts the game by moving three pieces of his choice across the ocean, trying:
   (A) To open a way into the enemy defense so as later to arrive at the capital;
   (B) To open a way to destroy the defence which the enemy has probably set up around his petroleum base;
   (C) to take one's own petrol-tankers to their base in order to get financial reinforcement.
2. In moving his pieces, a player tries to place them in a situation to fire at the enemy pieces and knock them out of the battle, but care is taken not to expose one's playing pieces too much.
3. After moving the playing pieces and having made payment to the cashier, a player sees which of them are in a position to fire. (Those which have enemy pieces within their line of fire). Notify the adversary, take the die and fire as often as you can.
4. Only after a player has fired all his shots, he gives his adversary his turn. He will in turn move three pieces of his choice, and he will fire afterwards.

Note: and the game continues like that, each one moving three pieces, firing with those which are in a condition so to do (always being careful to destroy the enemy pieces which are threatening his) until one of the two manages to destroy the capital of the other one or somebody goes bankrupt.

MANOEUVRES OF THE BATTLESHIPS OR CRUISERS

If it is necessary to turn one of these pieces during the game, notify the manoeuvre and turn the piece as per the drawing. A player can use any of the four small squares it occupies as the axis.

The battleship, with fires with nine cannons, has its sides protected, plus the front. Thus, placed transversally, it can better protect the capital, as well as being far less vulnerable.

A. CONCERNING THE MOVES AND THE PAYMENTS

1. Each player should move three pieces at each turn;
2. Each sea piece moved will pay the cashier one dollar per small square advanced. The aircraft and the capitals cost four dollars per large square when moved.
3. The payment should be made to the cashier at the time of making the move,
4. All the pieces moved during a turn and which are in a position to fire should fire.

B. CONCERNING FIRING AND AIRCRAFT

1. The pieces with firing power will only be able to fire after having been moved;
2. The pieces will fire once per target within their range, and if there are more than one, they will fire at all of them.
3. Each shot should be preceded by a Complete Notification: Which piece will fire and which is the target aimed at,
4. If the shot is fired without the notification beforehand, the shot is lost, if it hits the enemy or not.
5. The player pays nothing for the shot;
6. If the player forgets to fire, he will lose the right to fire, once the turn to play has passed on to the adversary,
7. Submarines cannot fire at capitals.

C. CONCERNING THE DISTRIBUTION OF THE PIECES

1. The capital will have to be hit twice before being destroyed.
2. If the capital is hit once, it should be turnup with the letters DAMAGED upwards, and may move normally;
3. The destroyer will have to be hit twice to be sunk. When it is hit, the letters DAMAGED will be turned upwards, and the piece will lose the power to fire sideways. At the second hit received, it goes out of play.
4. The petroleum base cannot be destroyed;
5. The other pieces when destroyed (one hit is enough) go out of play and return to the cashier;
6. When a player destroys a petrol-tanker of the adversary, he will receive U.S.$40,00 from the cashier.

D. CONCERNING THE PETROL-TANKERS

1. A petrol-tanker which reaches its base in the enemy territory will receive the following from the cashier:

| | |
|---|---|
| 1st Petrol-tanker | U.S.$100.00 |
| 2nd Petrol-tanker | U.S.$120.00 |
| 3rd Petrol-tanker | U.S.$150.00 |

D. THE SHOTS

Note that all the pieces, excepting for the capitals, petroleum bases, petrol-tankers and destroyers, have cannons drawn on them.

To fire shots, the players use the dice.

EACH PIECE FIRES ACCORDING TO THE DIRECTION AND THE NUMBER OF CANNONS IT POSSESSES

1. If it is red's turn to play. He moves the aircraft from square A to square B, to attack a white players cruiser.
2. Because of having moved, the aircraft is in a firing position, It will attack the enemy. Any piece which is six squares in front of it, in the direction of the cannons, is in danger — in this case the cruiser.
3. The red player advises the adversary that he is going to fire at the cruiser and throws the dice. If the dice throws 2, 3 or 4, the cruiser will be hit and leaves the game. If 1, 5 or 6 is thrown, the shot was lost. As may be noted, the number of small squares is counted, starting from the piece which fired, compared with the number drawn on the dice. The impact or hit will be when the numbers fall together or correspond.

E. FIRING POWER

Let us continue with the example above. You know the cruiser has cannons on the sides. You know that, when a piece is moved, it produces conditions for firing. So, the cruiser fires forward and destroys the aircraft, but if there were other enemy pieces to the side of the cruiser and within the reach of its cannons (within the six spaces which the die can reach), what should be done?

You continue firing, notifying which is the target you are trying to hit.

CONCLUSION:

Every piece, when it is moved, fires once for every target that is within reach of its cannons.

Example: In this case, the cruiser, having moving, produced conditions for firing at the aircraft, the submarine, the petrol-tanker and the battleship of the enemy. It will fire once at each target.

Example 2 (illustration 2).

Note: The cruiser to advance from A to B crossed six small squares. All the ships will use this method in their moves.

Note: Moving sideways.

The ships may move sideways, always counting the small squares.

Look at the example below:

(Illustration 3)

C. THE PIECES AND THEIR MOVEMENTS

Each piece declares of itself what its possibilities of movement are, its direction and the number of squares it may advance on each move.

Let us take the example of the aircraft:

On the left wing there is the number (five) written inside a square; that means that this piece can travel up to five big squares per move.

On the right wing their are directional arrows. They show that the aircraft can move forwards, sideways or diagonally.

The signs show that it cannot go backwards. Look at the drawing to the side to see what the possibilities are for the aircraft to move. Repeat the movements on the board. It is easy, isn't it?

F. THE REACH OF THE DESTROYER's ROCKETS

Note that the destroyers have a missile printed on them. This means that this piece can send missiles against the enemy, and so it has a greater reach. It only fires forwards, like the submarine and the aircraft. However, its firing-power is doubled, and it reaches two small squares. Thus, any piece which is within two small squares thrown on the die is hit.

G. THE PAYMENT

1. Every piece to be moved must pay the cashier 1 (one) dollar per small square advanced.

EXAMPLE:

The cruiser moves from A to B, advancing seven small squares. Pay seven dollars to the cashier.

AIRCRAFT AND CAPITALS

Cost per movement:

The aircraft and the capitals to move use the big squares, which are formed of 4 small ones at 1 dollar each, so they will pay 4 dollars per square advanced.

Example: If the aircraft advances from A to B, travelling four squares, it will pay four dollars = U.S.$16.00.

NOTE: The aircraft and capitals cannot move half a square, they can only move on the big (entire) squares which are clearly marked out on the board.

H. SPYING

There are 30 chance cards which the player can use when he wants to get out of a difficult situation.

Of the 30 chance cards, 15 give chances to the player to get help and turn the game back in his favour. But the other 15 can end his hopes and finish up by defeating him.

I. HOW THE GAME IS PLAYED

1. The cashier — His attributes:

The cashier, who is also umpire, may be one of the competitors, in the case of a pair of singles or doubles, Or he might be a 3rd or 5th person.

He has the following duties:

1. To distribute the pieces and the money;
2. To receive money for the movements and manoeuvres of the pieces on the board;
3. To sell the pieces held back in the arsenal;
4. To pay for the anchoring or sinking of petrol-tankers;
5. To direct the drawing of the spying cards, paying or receiving as a consequence (See rules below);
6. To solve the doubts which may arise between the competitors, using these rules, or, when they give no solution, using good sense.

E. CONCERNING THE TURNING OF SHIPS (MANOEUVRES)

1. The battleships and cruisers can also be placed on the board in a longitudinal position;

2. If it is desired to turn them during the game, they may be turned in another direction, and for their manoeuvre they will have to pay the cahier:
   turn of a battleship U.S.$30.00
   turn of a cruiser U.S.$20.00
3. In the case of such a turn, the player will lose the right to move his other two pieces.
4. The piece that turns will have the right to fire;
5. The piece that turns will have to take as a central axis um of the small squares it is occupying.

F. CONCERNING SPYING

1. The player can only appeal to SPYING if he has less than U.S.$50.00 and never less that U.S.$20.00;
2. The adversary should shuffle the cards and let the enemy draw one of them;
3. The result of the spying will be read aloud.

G. CONCERNING REPLACING PIECES

1. When a player has lost five pieces, he has the right to buy new ones;
2. The cashier will have to sell these pieces to the players at the following table:

| PIECE | quantity | cost |
|---|---|---|
| Aircraft | up to 2 | U.S.$40.00 each |
| Submarines | up to 1 | U.S.$50.00 each |
| Battleships | up to 1 | U.S.$100.00 each |
| Cruisers | up to 2 | U.S.$80.00 each |
| Destroyers | up to 1 | U.S.$40.00 each |

3. The pieces bought can only be placed in their own sea and can only be moved during the next turn.

H. CONCERNING BANKRUPCY

1. The player who is without money to move his 3 pieces goes BANKRUPT and loses the game, even if his capital has not been hit.
2. If the player only has money to move two pieces or one, he is also BANKRUPT and loses the game.
3. The player who has 50 or 30 dollars and resorts to spying, can go BANKRUPT if he has to pay to the cashier or the adversary a sum greater than his capital.

I. CONCERNING THE LACK OF PIECES

1. The player who has less than four pieces and has no money to buy any more from the cashier will lose the game, even if his capital has not been hit.

FINAL CONSIDERATIONS

Read these instructions and rules to a group of persons players and then read them over again to eliminate doubts. If everybody understands them properly, the game will be a real WAR, where you have to use your head and your money to win. Give no quarter to the enemy, for, as you know, WAR IS WAR!

RESUME

Invention Patent for a "Set for entertainment", consisting of a board, 1, which preferably has 224 adjacent squares, 2, each one being able to be divided into four smaller squares, each one having a circircle, 3, the board being formed of two colours which define three transversal strips, a central and larger one and two outside and smaller ones; seven types of pieces, all in the form of small plaques with different outlines, one bigger square one, 4, representing the capital city, one in the form of a drop, 5, representing the submarines, one in a rectangular form coming to an outside point, 6, representing the petrol-tankers; one elongated one with an outside point, 7, representing the destroyers, a further one, 8, of the same format, but even longer, representing the cruisers, and a bigger one still, 9, representing the battleships, as well as a last one, an elongated rectangle, 10, representing the petroleum bases and aircraft, which pieces should be with different sets of colours. The set also consists of small sheets of paper representing money, as well as cards with acts to be carried out, punishments and chances.

I claim:

1. In a game of strategy and chance, a board having a major surface for playing thereon and divided into squares each subdivided into four smaller squares, a plurality of playing pieces of seven different configurations, said pieces including several of each configuration, other playing pieces representative of fixed targets comprising capitals of opponent players, and petroleum bases of opponents positionable on said board playing surface in a given zone, the playing pieces of each configuration being representative of a movable weapons system that are targets for an opponent player able to cause removal of another target when within a firing range of said another target on said board, a plurality of monetary elements representative of different monetary values for buying said weapons systems and for payment of extent of movement of corresponding ones of said moveable weapons systems, a die for throwing thereof to ascertain the distance the weapons systems fire upon the throwing of the die, the result of each die throw denoting the range of the firing of said weapons systems, each weapons system having an effective range of firing and that range being a predetermined distance, and when the result on the die thrown corresponds with or is proportional to the number of smaller squares between a weapons system and a target being fired upon said target thereby being removable from said board and a plurality of cards having instructions thereon corresponding to acts to be carried out, punishments and chances.

2. In a game of strategy and chance according to claim 1, in which said board has zones of two different colors denoting zones of occupation by two different opposing players.

* * * * *